US005152306A

United States Patent [19]

Stephan

[11] Patent Number: 5,152,306

[45] Date of Patent: Oct. 6, 1992

[54] HAIRDRESSING COMB AND HAIRDRESSING KIT INCLUDING EACH COMB

[76] Inventor: Carl W. B. Stephan, 20 Drommedaris Street, Gordon's Bay, Cape Province, South Africa

[21] Appl. No.: 615,974

[22] Filed: Nov. 20, 1990

[30] Foreign Application Priority Data

Nov. 22, 1989 [ZA] South Africa ..... 89/8914
Apr. 27, 1990 [ZA] South Africa ..... 90/3247

[51] Int. Cl.[5] ..... A45D 24/04

[52] U.S. Cl. ..... 132/139; 132/219; 132/160

[58] Field of Search ..... 132/126, 137, 139, 141, 132/142, 219, 212, 160

[56] References Cited

U.S. PATENT DOCUMENTS

| | | | |
|---|---|---|---|
| 1,533,684 | 4/1925 | Abeel | 132/144 |
| 1,536,485 | 5/1925 | Fanning | 132/126 |
| 1,827,425 | 10/1931 | Ellzey | 132/139 |
| 2,598,330 | 5/1952 | Wilson | 132/142 |
| 2,806,476 | 9/1957 | Thompson | 132/158 |
| 2,915,071 | 12/1959 | Watkins | 132/213.1 |
| 2,949,920 | 8/1960 | Humphrey | 132/213.1 |
| 3,125,101 | 3/1964 | Clark | 132/213.1 |
| 3,181,540 | 5/1965 | Abraham | 132/160 |
| 3,552,403 | 1/1971 | Sestito | 132/150 |
| 4,732,170 | 3/1988 | Thomas | 132/160 |
| 4,996,996 | 3/1991 | Hirsh | 132/219 |

FOREIGN PATENT DOCUMENTS

| | | | |
|---|---|---|---|
| 1151666 | 2/1958 | France | 132/142 |

*Primary Examiner*—John G. Weiss
*Assistant Examiner*—Michael Lynch
*Attorney, Agent, or Firm*—Ladas & Parry

[57] ABSTRACT

A hairdressing comb comprises a series of hair lifting teeth each having a barb or hook-like formation at the end thereof, and, between each adjacent pair of hair lifting teeth, one or more plain comb teeth. The comb forms part of a hairdressing kit 30 for use in the foil highlighting of hair. The kit further comprises a former and a tray. The former facilitates the cutting of a sheet of metal foil into strips of equal width which fit in the tray.

6 Claims, 3 Drawing Sheets

HAIRDRESSING COMB AND HAIRDRESSING KIT INCLUDING EACH COMB

FIELD OF THE INVENTION

This invention relates to a hairdressing comb and to a hairdressing kit including such a comb.

The kit of the invention is particularly useful in the hairdressing technique known as foil highlighting. In this technique sections of hair are successively scaled out, tufts of hair separated from each scaled out section, and a highlighting preparation then applied to the tufts. Strips of metal foil are used to separate the treated tufts from the rest of the hair so as to avoid the highlighting preparation from coming into contact with the rest of the hair during the time that the highlighting preparation requires to take effect. After the highlighting preparation has taken effect the strips of metal foil are removed and the highlighting preparation rinsed off.

BACKGROUND OF THE INVENTION

The conventional manner of carrying out foil highlighting is as follows. First, a section of hair is scaled out and held between the first and middle fingers of the hair stylist. The tail of a tail comb is then woven through the section and lifted, thereby separating tufts of hair from the section. The remaining hair of the section is allowed to fall back onto the head of the person whose hair is being done. A strip of metal foil is now inserted underneath the separated tufts, whereupon the tufts are then released so that they fall back onto the foil. A highlighting preparation is then applied to the separated tufts, using the head of the person whose hair is being done as a support. The conventional technique is slow and cumbersome, and the results depend to a large extent on the skill of the hair stylist.

It is an object of the present invention to provide a hairdressing comb and a hairdressing kit which will facilitate and considerably speed up the process of foil highlighting, and will enable the technique to be carried out at home by relatively unskilled persons.

SUMMARY OF THE INVENTION

According to the invention there is provided a hairdressing comb which comprises a series of hair lifting teeth each having a barb or hook-like formation at the free end thereof, and, between each adjacent pair of hair lifting teeth, one or more plain comb teeth.

The comb may be double sided, said hair lifting teeth and said plain comb teeth being on one side of the comb, and the comb further having a series of plain comb teeth on the other side thereof.

Further according to the invention there is provided a hairdressing kit which includes:

a hairdressing comb which comprises a series of hair lifting teeth each having a barb or hook-like formation at the free end thereof, and, between each adjacent pair of hair lifting teeth, one or more plain comb teeth; and an elongate former having a groove in, and extending along, at least one longitudinal edge thereof, around which former a length of metal foil can be wound in several superimposed layers so that the foil layers span said groove, a pointed instrument then being insertable in and displaceable along said groove to tear all of said foil layers along the groove, thereby to form the length of foil into strips of foil.

The comb may be a tail comb having a tail, the free end of the tail being insertable in, and displaceable along, said groove to tear all of said foil layers along the groove.

The kit may further include an elongate tray for holding one of said strips of foil, the tray having a bottom whose width is substantially equal to the width of said strips and has a front end and a rear end, an upstanding wall along each longitudinal side of the bottom, and a hand grip at said rear end, the bottom sloping upwardly to the hand grip.

The front end of the tray may have a curvature which corresponds to the curvature of a person's head.

The invention will now be described in more detail, by way of example, with reference to the accompanying drawings.

DETAILED DESCRIPTION OF PREFERRED EMBODIMENTS

Figure 1:
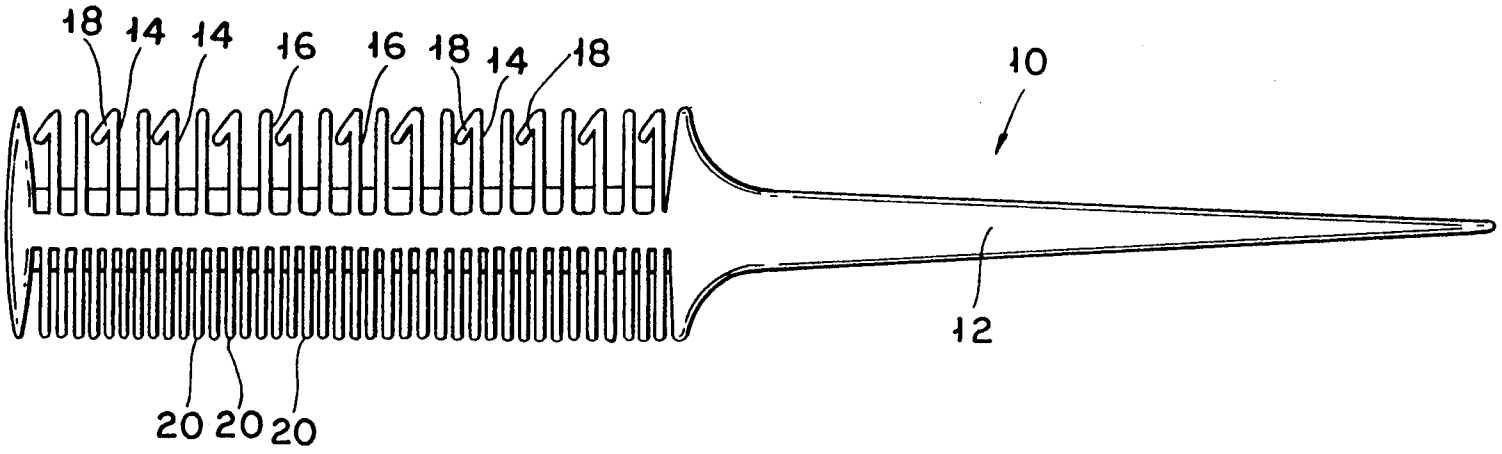
FIG. 1 illustrates a hairdressing comb in accordance with the invention.
Figure 2A:
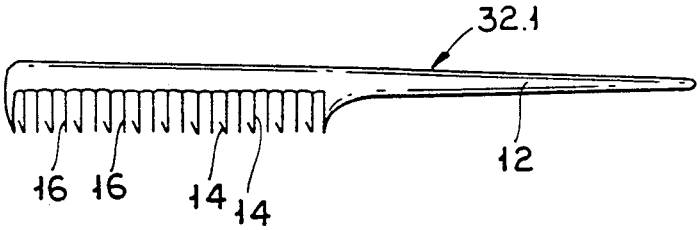
FIG. 2 illustrates various component parts of a hairdressing kit in accordance with the invention.
Figure 2B:
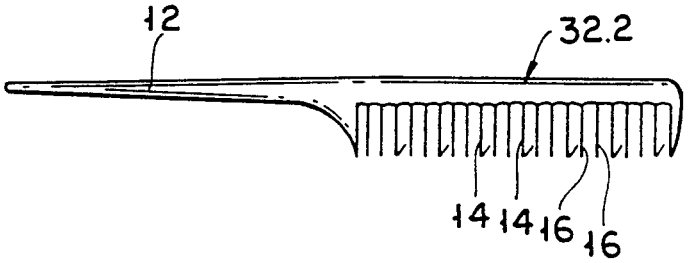
Figure 2C:
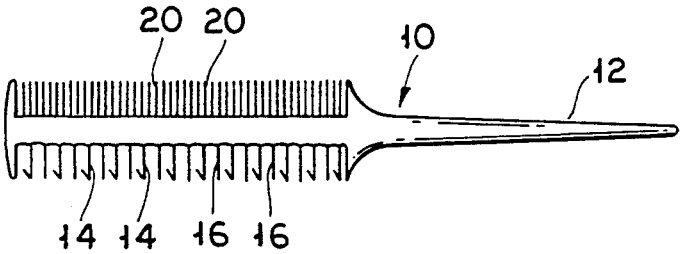
Figure 2D:
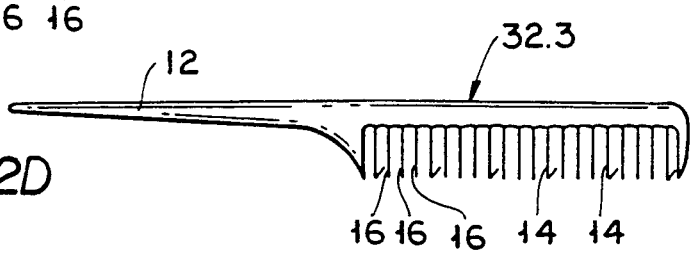
Figure 2E:
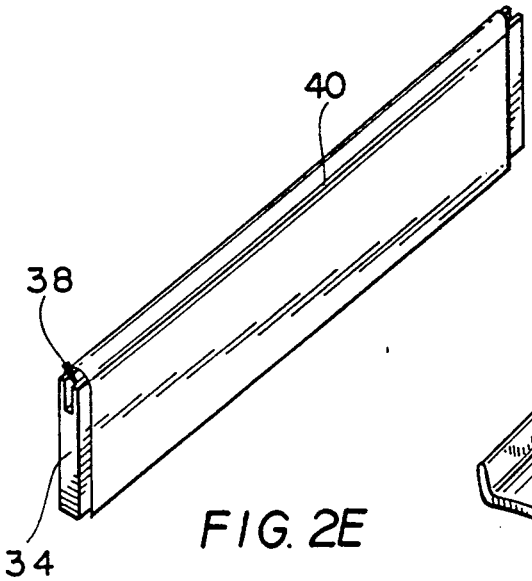
Figure 2F:
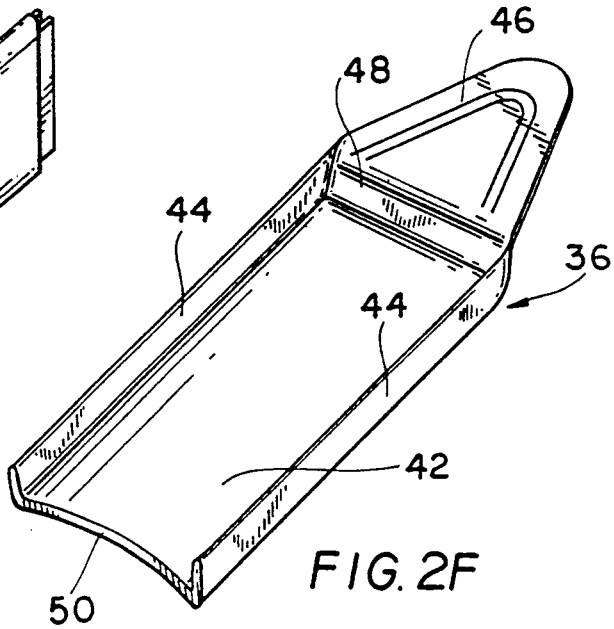

Referring first to FIG. 1, reference numeral 10 generally indicates a double sided tail comb having a tail 12. On one side of the comb there is a series of hair lifting teeth 14 and, between each pair of adjacent hair lifting teeth, a plain comb tooth 16. Each of the hair lifting teeth 14 has a barb or hook-like formation 18 at the end thereof. .On the other side of the comb there is a series of plain teeth 20, so that the comb can be used as a conventional comb.

Referring now to FIG. 2, reference numeral 30 generally indicates a hairdressing kit which comprises a number of hairdressing combs, there being a comb 10 as also illustrated in FIG. 1, and combs 32.1, 32.2, and 32.3. The kit further comprises a flat, elongate former 34, and an elongate tray 36.

The comb 32.1 is similar to the comb 10, the same reference numerals indicating the same parts. It differs from the comb 10 in that it is a single sided comb and thus does not have any teeth on the side opposite the side with the teeth 14 and 16.

The comb 32.2 is similar to the comb 32.1, the same reference numerals indicating the same parts. It differs from the comb 32.1 in that, between each adjacent pair of hair lifting teeth 14, there are two plain comb teeth 16. The spacing between adjacent hair lifting teeth 14 in the comb 32.2 is therefore greater than that in the combs 10 and 32.1.

The comb 32.3 is similar to the combs 32.1 and 32.2, the same reference numerals indicating the same parts. It differs from the combs 32.1 and 32.2 in that, between each adjacent pair of hair lifting teeth 14, there are three plain comb teeth 16. The spacing between adjacent hair lifting teeth 14 in the comb 32.2 is therefore greater than that in the comb 32.2.

The former 34 consists of a flat, elongate element having a groove 38 in one of the longitudinal edges thereof. This will facilitate cutting of a length of aluminium foil 40 into strips which all have the same width. This is done by winding the aluminium foil 40 in several windings onto the former so that the foil layers span the groove 38. The tail 12 of one of the combs 10 or 32.1 to 32.3 is then inserted into the groove 38 at one end and displaced along the groove to the other end, thereby simultaneously cutting or tearing all the layers of aluminium foil 40 and forming the aluminium foil into a number of strips of equal width, the width being slightly greater than the width of the former 34.

The tray 36 has a bottom 42 whose width is approximately equal to twice the width of the former 34. Along each opposite longitudinal side of the bottom there is an upstanding wall 44. At the rear, the tray has a hand grip 46, the bottom 42 sloping upwardly to the handgrip as shown at 48. The front end of the bottom has a convex curvature in transverse cross section, when viewed from above, giving the forward edge 50 of the bottom a concave curvature when viewed from underneath, so that the forward end of the tray can fit snugly against the head of a person whose hair is being done.

Figure 3:
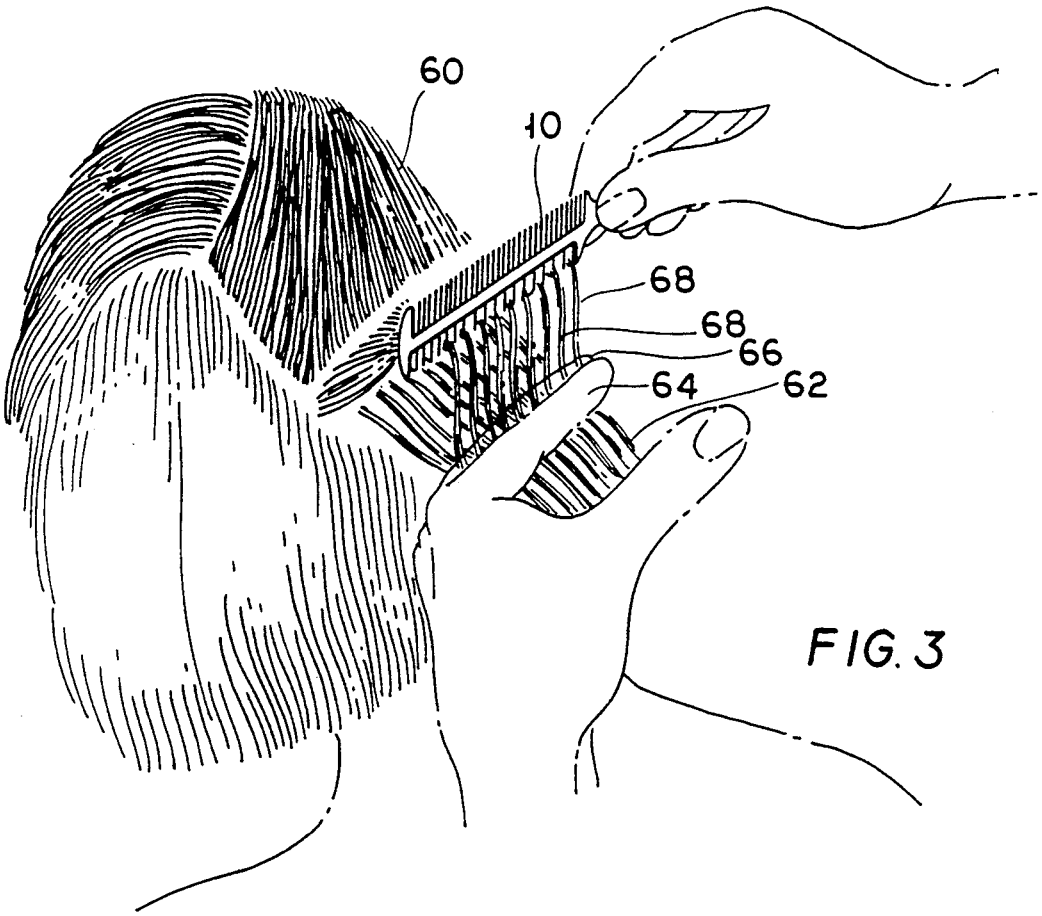
FIGS. 3 and 4 illustrate the use of the kit to perform certain steps in a foil highlighting operation.

Referring now to FIG. 3, reference numeral 60 indicates the head of a person whose hair is being done, and reference numeral 62 a section of hair that has been scaled out and is held between the first and middle fingers 64, 66 of the hair stylist. As can further be seen in FIG. 3, the hairdressing comb 10 has been inserted into the section 62 with the hair lifting teeth 14 directed downwardly, and the comb then raised. This causes the hair lifting teeth 14 to lift tufts 68 of hair away from the rest of the section. Before the comb 10 is raised it displaced slightly to the left (as viewed in FIG. 1). This ensures that all the hair that has entered into the gap between each hair lifting tooth 14 and the adjacent plain tooth 16 is engaged by the barb or hook-like formation 18 and subsequently lifted when the comb is raised. This accurately determines the amount of hair in each tuft 68. Furthermore, the spacing between adjacent hair lifting teeth 14 accurately determines the spacing between adjacent tufts 68.

The tufts 68 are gathered by the hair stylist and the remainder of the section 62 allowed to fall back onto the head 60.

Figure 4:
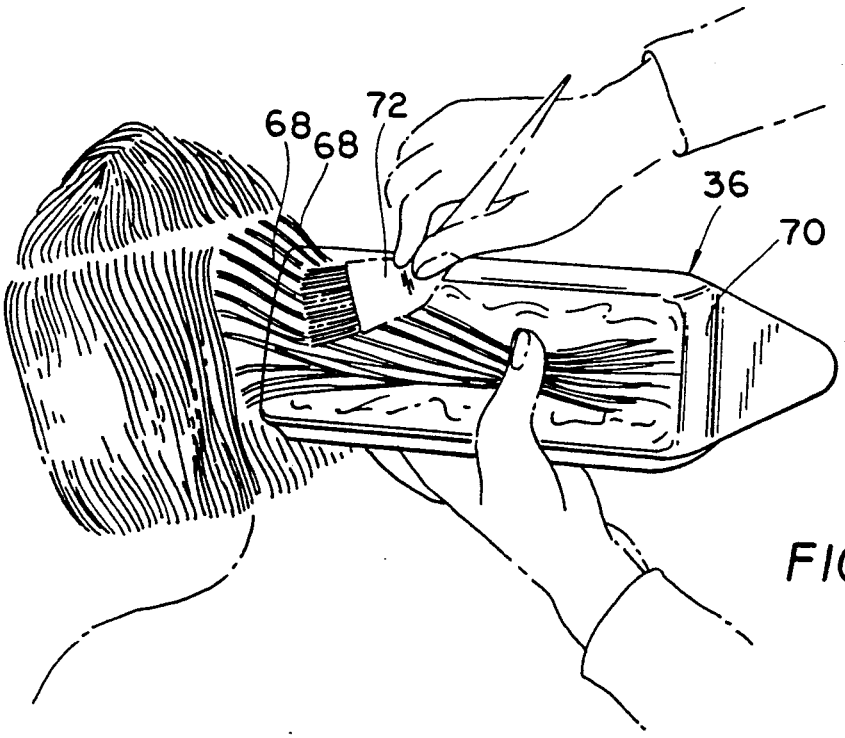

A strip of aluminium foil which has been formed as described above is placed in the tray 36, the strip being indicated by reference numeral 70 in FIG. 4. The strip fits snugly in the tray, the walls 44 locating it against lateral displacement. The strip is pressed downwardly at the rear of the tray. This causes the rear end of the strip to extend upwardly along the sloping portion 48 and beyond the lever of the hand grip 46. This will make it easy subsequently to take hold of the rear end of the strip when it is to be folded over forwardly as will be described hereinafter. The forward end of the strip is folded downwardly around the forward edge 50 of the tray. The tray 36 with the strip of foil 70 in it is now placed in position underneath the separated tufts 68 and held with the forward edge against the head 60.

A highlighting preparation is now applied to the tufts 68 by means of a tint brush 72. Once that has been done the rear end of the foil strip 70 is taken hold of and folded forwards to cover the tufts 68, and the tray 36 is withdrawn.

The procedure described above is repeated for a number of sections of hair. The highlighting preparation is then allowed some time to take effect, whereafter the foil strips 70 are removed and the hair rinsed.

The combs 10, and 32.1 to 32.3 illustrated herein are also useful in the hairdressing technique known as weave perming, in which tufts of hair are lifted away from the rest of the hair and rolled up, before a perm lotion is applied to the hair. Furthermore, the combs 10, and 32.1 to 32.3 illustrated herein are useful in the hairdressing technique known as texture cutting, in which tufts of hair are lifted away from the rest of the hair and cut.

I claim:

1. A hairdressing comb which comprises a series of hair lifting teeth and, between each adjacent pair of hair lifting teeth, one or more plain comb teeth, each hair lifting tooth having a fixed end, a free end and, at the free end, a barb or hook-like formation which forms an angle of less than 90° with the respective tooth.

2. A hairdressing comb according to claim 1, which is double sided, said hair lifting teeth and said plain comb teeth being on one side of the comb, and the comb further having a series of plain comb teeth on the other side thereof.

3. A hairdressing kit which includes:

a hairdressing comb which comprises a series of hair lifting teeth and, between each adjacent pair of hair lifting teeth, one or more plain comb teeth, each hair lifting tooth having a fixed end, a free end, and, at the free end, a barb or hook-like formation which forms an angle of less than 90° with the respective tooth; and an elongate former having a groove extending in the longitudinal direction thereof, around which former a length of metal foil can be would in several superimposed layers so that the foil layers span said groove, a pointed instrument then being insertable in and displaceable along said groove to tear all of said foil layers along the groove, thereby to form the length of foil into strips of foil.

4. A hairdressing kit according to claim 3, wherein the comb is a tail comb having a tail, the free end of the tail being insertable in, and displaceable along, said groove to tear all of said foil layers along the groove.

5. A hairdressing kit according to claim 3, which further includes an elongate tray for holding one of said strips of foil, the tray having a bottom whose width is substantially equal to the width of said strips and has a front end and a rear end, an upstanding wall along each longitudinal side of the bottom, and a hand grip at said rear end, the bottom sloping upwardly to the hand grip.

6. A hairdressing kit according to claim 5, wherein the front end of the tray has a curvature which corresponds to the curvature of a person's head.

* * * * *